US008357428B2

(12) United States Patent
Ito et al.

(10) Patent No.: US 8,357,428 B2
(45) Date of Patent: Jan. 22, 2013

(54) METHOD FOR PRODUCING POROUS FILM

(75) Inventors: Koju Ito, Minami-ashigara (JP); Hidekazu Yamazaki, Minami-ashigara (JP)

(73) Assignee: FUJIFILM Corporation, Tokyo (JP)

( * ) Notice: Subject to any disclaimer, the term of this patent is extended or adjusted under 35 U.S.C. 154(b) by 752 days.

(21) Appl. No.: 12/413,938

(22) Filed: Mar. 30, 2009

(65) Prior Publication Data

US 2009/0246365 A1 Oct. 1, 2009

(30) Foreign Application Priority Data

Mar. 31, 2008 (JP) ..... 2008-091518

(51) Int. Cl.
*B05D 5/00* (2006.01)

(52) U.S. Cl. ..... 427/244; 427/264; 427/270; 427/273; 427/373; 427/377; 427/407.1; 264/557

(58) Field of Classification Search ..... 427/244, 427/264, 377, 384, 248.1, 243, 270, 271, 427/273, 407.1; 428/304.4–319.9, 131; 264/212, 264/129, 132, 134, 280, 284, 557
See application file for complete search history.

(56) References Cited

U.S. PATENT DOCUMENTS 6,306,204 B1 * 10/2001 Lin ..... 106/31.43
2006/0266463 A1 * 11/2006 Washizu et al. ..... 156/246

FOREIGN PATENT DOCUMENTS

JP 2002-335949 A 11/2002

OTHER PUBLICATIONS

Polymer Microsieves Manufactured by Inkjet Technology, Stephan F. Jahn, Lutz Engisch, Reinhard R. Baumann, Susann Ebert, and Werner A. Goedel, Langmuir 2009 25 (1), 606-610, Published Dec. 9, 2008.*

* cited by examiner

*Primary Examiner* — Frederick Parker
*Assistant Examiner* — Alex A Rolland
(74) *Attorney, Agent, or Firm* — Sughrue Mion, PLLC

(57) ABSTRACT

After a second liquid is applied to a support and dried, a first liquid is applied thereon. On a film of the first liquid, a third liquid (water) is supplied in droplets using an inkjet-type liquid supply unit. An area supplied with the droplets is referred to as porous area. Next, an organic solvent is evaporated from the film and the droplets are evaporated from the porous area. Thus, a porous film is obtained. The porous film has the porous areas in which a plurality of pores are arranged. Since the droplets are directly formed by an inkjet printing method, a condensation process and a droplet growing process are unnecessary. Thus, the porous film is produced efficiently. Shapes of the porous areas can be changed easily. The porous areas can be formed on the porous film in various patterns.

7 Claims, 5 Drawing Sheets

METHOD FOR PRODUCING POROUS FILM

FIELD OF THE INVENTION

The present invention relates to a method for producing a porous film.

BACKGROUND OF THE INVENTION

In the fields of optics and electronics, higher integration density, information of higher density, and image information with higher definition are required increasingly. For this reason, films with finer structures are strongly desired in such fields. In the medical field, the films with fine structures (microstructures) are also desired, for example, films that provide scaffolds for the cell culture, and membranes used for hemofiltration.

Examples of the microstructure films include films with honeycomb structures in which a plurality of micropores at a μm level are arranged in a honeycomb-like manner. To produce the honeycomb-structure film, a solution in which a predetermined polymer compound is dissolved in a hydrophobic organic compound is cast, and droplets are formed in a surface of a casting film by condensation. Such droplets are evaporated concurrently with evaporation of the organic compound (for example, see Japanese Patent Laid-Open Publication No. 2002-335949). The film produced in the above method is called a self-assembled membrane from formation behavior of its microstructure.

Conventionally, humidified (moist) air is condensed for forming droplets so as to form a porous structure. However, since condensation is a natural phenomenon, it is difficult to precisely control the extent thereof, and exact temperature control is necessary for uniform condensation. Therefore, improvements in forming of the droplets are desired.

SUMMARY OF THE INVENTION

An object of the present invention is to provide a porous film producing method in which droplets are formed speedily.

Another object of the present invention is to provide a porous film producing method in which a porous film with large pores is produced efficiently.

In order to achieve the above objects and other objects, a method for producing a porous film having a plurality of pores according to the present invention includes an applying step, a droplets supplying step and a pore forming step. In the applying step, a film is formed by applying a first liquid on a support. The first liquid contains a polymer compound and a solvent. In the droplets supplying step, droplets of a second liquid are supplied from an inkjet head on the film. In the pore forming step, the solvent and the droplets are evaporated to form the plurality of pores in the film.

It is preferred that the first liquid or the second liquid contains an amphipathic compound. It is preferred that the droplets supplying step is performed in an atmosphere at relative humidity in a range from 40% to 95%.

It is preferred to place the film in an atmosphere at relative humidity in a range from 40% to 95% for at most one minute after the droplets supplying step. It is preferred that the droplets supplying step is performed while the surface temperature of the film is kept in a range from 0° C. to 30° C. It is preferred that the second liquid contains fine particles.

It is preferred that the present invention further includes a droplets growing step in which the droplets increase in size.

According to the present invention, the droplets are supplied onto the film surface using the inkjet head. Therefore, condensation is not necessary. As a result, droplets are formed speedily and uniformly. Instead of growing the droplets formed by the condensation, the droplets supplied by the inkjet head are used. The droplets supplied by the inkjet head are larger than those formed by the condensation. As a result, time necessary for the growth of the droplets is unnecessary so that the production time is shortened and pores uniform in diameter are formed.

BRIEF DESCRIPTION OF THE DRAWINGS

The above and other objects and advantages of the present invention will be more apparent from the following detailed description of the preferred embodiments when read in connection with the accompanied drawings, wherein like reference numerals designate like or corresponding parts throughout the several views, and wherein:

FIG. 8A is an application pattern in which the porous are is divided in three divided areas by radioactive rays; and FIG. 8B is an application pattern in which the porous area is concentrically divided in three divided areas.

DESCRIPTION OF THE PREFERRED EMBODIMENTS

Figure 1:
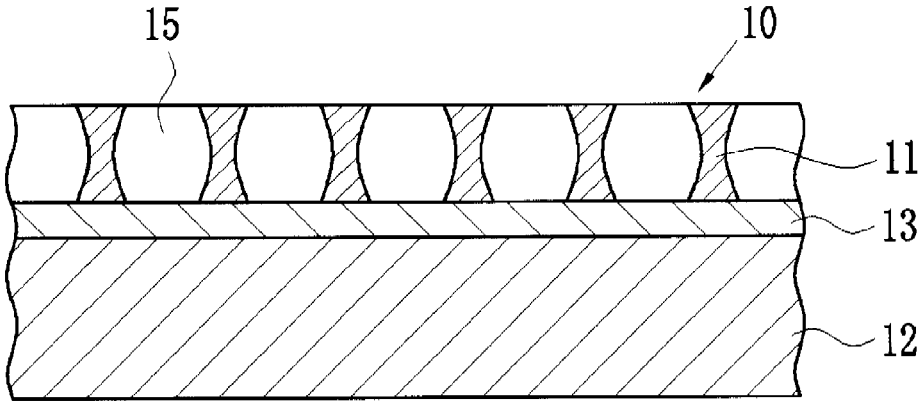
FIG. 1 is an enlarged section view of a porous film of the present invention.
Figure 2:
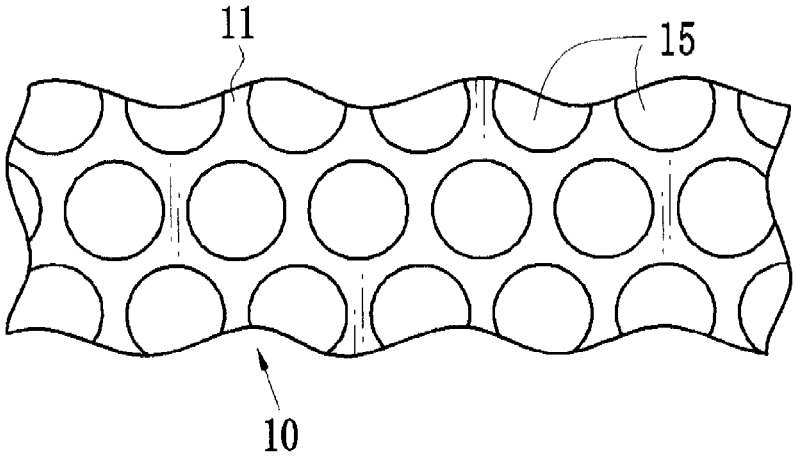
FIG. 2 is an enlarged plane view of the porous film.

As shown in FIG. 1, a porous film 10 of the present invention includes a porous layer 11 formed with a plurality of pores 15, a support 12 for supporting the porous layer 11, and a middle layer 13 sandwiched between the porous layer 11 and the support 12. In this embodiment, the pores 15 are independent from each other. Alternatively, the pores may be connected to each other. As shown in FIG. 2, each pore 15 is substantially circular in shape. The porous film 10, as a whole, has a honeycomb structure with densely packed pores 15.

Figure 3A:
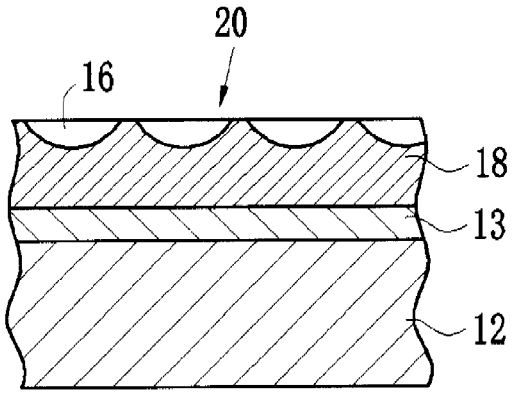
FIG. 3A is an enlarged cross section of a porous film of another embodiment having shallow pores (hollows)
Figure 3B:
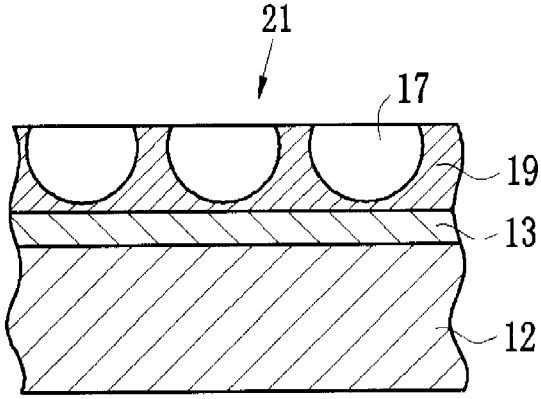
FIG. 3B is an enlarged cross section of a porous film of another embodiment having deep pores (hollows)

The pores 15 shown in FIG. 1 are through holes formed in the porous layer 11. Alternatively, shallow pores (hollows) 16 as shown in FIG. 3A or deep pores (hollows) 17 as shown in FIG. 3B may be formed. The pores 15, 16 and 17 are formed on porous layers 11, 18 and 19, respectively, by controlling a droplets growing process, which will be described later. For example, the shallow pores 16 are formed by stopping the growth of droplets at an early stage. The pores increase in depth as they grow, and thus the pores 15 and 17 are formed. In porous films 20 and 21 shown in FIGS. 3A and 3B, a component similar to that in FIG. 1 is designated by the same numeral shown in FIG. 1, and a description thereof is omitted.

The porous layer 11 is formed from a first liquid 35 (see FIG. 4) containing a first polymer. The middle layer 13 is formed from a second liquid 36 (see FIG. 4) containing a second polymer. The support 12 and the middle layer 13 are not essential requirements in the present invention and provided as necessary. Instead of adopting a three-layer structure of the porous layer 11, the middle layer 13, and the support 12 as shown in FIGS. 1 to 3B, the support 12 and the middle layer 13 may be omitted, or the porous layer 11 may be peeled from the support 12 or the middle layer 13 in a film production process or when in use. In this case, the porous film 10 is formed with the porous layer 11 only, or has a two-layer structure of the porous layer 11 and the middle layer 13. The middle layer 13 may have a single or multiple layers as necessary.

The middle layer 13 is preferably provided to the porous layer 11 with the support 12. The middle layer 13 is also effective in supporting and protecting the porous layer 11 when the support 12 is peeled off and the porous film 10 has a two-layer structure of the porous layer 11 and the middle layer 13. The middle layer 13 is formed from the second polymer. The second polymer may be the same material as the first polymer. In this case, the thickness of the porous film 10 is increased, which provides self-supporting property. The second polymer may have a different composition from that of the first polymer. The second polymer may be soluble or insoluble in the first polymer.

The support 12 is necessary to the porous layer 11 in the film production process and in a product form except that the porous layer 11 has the self-supporting property. The support 12 may be used throughout the film production process and for the porous film 10 in the end-product form. Alternatively, a support specific for the film production process may be used. Such support may be referred to as film production support. In continuous film production, a stainless steel endless belt or a drum, or a polymer film may be used as the film production support. In film production using cut-sheet type supports, plate-like supports formed of stainless steel, glass, or polymer may be used. Such plate-like supports may be used during the film production process and for the end products.

The porous layer 11 is formed from a hydrophobic polymer compound and an amphipathic compound. Thereby, the droplets are formed more uniformly in shape and size in a porous film production method which will be described later. It is especially preferred that the middle layer 13 is a polymer compound. However, the middle layer 13 is not necessarily a polymer compound. The middle layer 13 may be, for example, an organic compound such as a monomer and an oligomer, or an inorganic compound such as $TiO_2$.

With the use of the film formed from the polymer compound as the support 12, the produced porous film 10 obtains flexibility. Compared to a porous material with a porous layer formed on glass, the porous film 10 is easy to handle and the porous film 10 has a high degree of flexibility in use. The high degree of flexibility means that the porous film 10 can be easily attached to a flat surface, bent, or cut into desired shapes. By virtue of the above, the porous film 10 can be used as a film for protecting wounds, a transdermal patch, and the like.

The first polymer and the amphipathic compound are used for forming the porous layer 11. A ratio between the number of hydrophilic groups and the number of hydrophobic groups, namely, (the number of hydrophilic groups)/(the number of hydrophobic groups) in the amphipathic compound is preferred to be in a range from 0.1/9.9 to 4.5/5.5. Thereby, finer droplets are more densely packed in a film formed from the first liquid 35. In a case that the value of (the number of hydrophilic groups)/(the number of hydrophobic groups) is smaller than the above range, the pores may vary in diameter and become nonuniform. The pores are judged nonuniform when a pore diameter variation coefficient (unit: %) obtained by the mathematical expression {(standard deviation of the pore diameter)/(an average pore diameter)}×100 is 10% or more. In a case the value of (the number of the hydrophilic group)/(the number of the hydrophobic group) is larger than the above range, an arrangement of the pores tends to be nonuniform.

The amphipathic compound may be formed of two or more different kinds of compounds. Thereby, the sizes and the positions of the droplets are more precisely controlled. The same effect can be obtained by using plural compounds as components of the polymer compound contained in the porous layer 11.

Preferable examples of the first polymer and the second polymer include vinyl polymer (for example, polyethylene, polypropylene, polystyrene, polyacrylate, polymethacrylate, polyacrylamide, polymethacrylamide, polyvinyl chloride, polyvinylidene chloride, polyvinylidene fluoride, polyhexafluoropropene, polyvinyl ethers, polyvinyl carbazole, polyvinyl acetate, polytetrafluoroethylene and the like), polyesters (for example, polyethylene terephthalate, polyethylene naphthalate, polyethylene succinate, polybutylene succinate, polylactate and the like), polylactones (for example, polycaprolactone and the like), cellulose acetate, polyamides and polyimides (for example, nylon, polyamic acid and the like), polyurethane, polyurea, polybutadiene, polycarbonate, polyaromatics, polysulfone, polyethersulfone, polysiloxane derivatives and the like.

Instead of the second polymer, gelatin, polyvinyl alcohol (PVA), sodium polyacrylate or the like may be used for forming the middle layer 13. In this case, the porous film 10 is nontoxic when used as the wound protection film or the transdermal patch. In addition, the middle layer 13 does not compromise the flexibility of the support 12. Therefore, it is easy to handle the porous film 10 and change its shape.

Examples of the polymer used as the support 12 are the same as those mentioned above as the preferable examples of the first polymer. In addition, to make the support 12 thick while imparting flexibility to the porous film 10, for example, cellulose acetate, cyclic polyolefin, polyester, polycarbonate, polyurethane, and polybutadiene are preferred. Thereby, the thick support 12 is produced at low cost, and the porous film 10 is resistant to tearing and its shape is easily changeable in use.

In this embodiment, water is used as a third liquid. Alternatively, a high-boiling point solvent may be used. It is preferred that the third liquid contains an amphipathic compound. A concentration of the amphipathic compound is preferred to be in a range from 0.01% to 20%. Thereby, joining of the droplets is prevented, and thus the porous film 10 with uniform-diameter pores is formed. In a case that the concentration of the amphipathic compound is less than 0.01%, the joining of the droplets easily occurs. In a case that the concentration of the amphipathic compound exceeds 20%, the droplets may become unstable in size and cannot be formed to uniform size.

Fine particles of the functional material may be added to the third liquid. Examples of such functional fine particles include medical agents and conductive fine particles. By adding the functional fine particles such as conductive fine particles to the droplets, surface of the pores are covered with the functional fine particles when the droplets are evaporated. Thus, a functional porous film is obtained. The conventional condensation methods are not capable of imparting such functionality.

A solvent for the first liquid 35 is not particularly limited as long as the solvent is hydrophobic and dissolves the polymer compound. Examples of the solvent include aromatic hydrocarbon (such as benzene and toluene), halogenated hydrocarbon (such as dichloromethane, chlorobenzene, carbon tetrachloride, and 1-bromopropane), cyclohexane, ketone (such as acetone and methyl ethyl ketone), ester (such as methyl acetate, ethyl acetate, and propyl acetate) and ether (such as tetrahydrofuran, and methyl cellosolve). A mixture of the above compounds may be used as the solvent. Alcohol may be added to the above compound or the mixture of the above compounds.

In a case the solvent containing no dichloromethane is used to minimize the influence on the environment, the solvent preferably contains ether with 4 to 12 carbon atoms, ketone with 3 to 12 carbon atoms, ester with 3 to 12 carbon atoms, brominated hydrocarbons such as 1-bromopropane, or a mixture of them. For example, a solvent mixture of methyl acetate, acetone, ethanol, and n-butanol may be used. The ether, ketone, ester, and alcohol may have a cyclic structure. A compound having two or more functional groups of the ether, ketone, ester, and alcohol (that is, —O—, —CO—, —COO—, and —OH—) can be used as the solvent.

A droplet forming speed, the depth of the droplets in the film, and the like are controlled by using two or more kinds of compounds as the solvent and changing the ratio of the compounds as necessary. The droplet forming speed and the depth of the droplets will be described later.

The first liquid 35 preferably contains the first polymer in a range from 0.02 pts. wt. to 30 pts. wt. relative to 100 pts.wt. of an organic solvent. Thereby, the porous layer 11 of high-quality is formed with high productivity. In a case that the first polymer is less than 0.02 pts. wt. relative to 100 pts.wt. of the organic solvent, longer time is necessary for evaporating the organic solvent due to its large proportion in the first liquid 35. As a result, the productivity of the porous film 10 decreases. On the other hand, in a case that the first polymer exceeds 30 pts. wt., the droplets formed by condensation cannot change the shape of the film of the first liquid 35. As a result, a surface of the porous layer 11 may become uneven.

Figure 4:
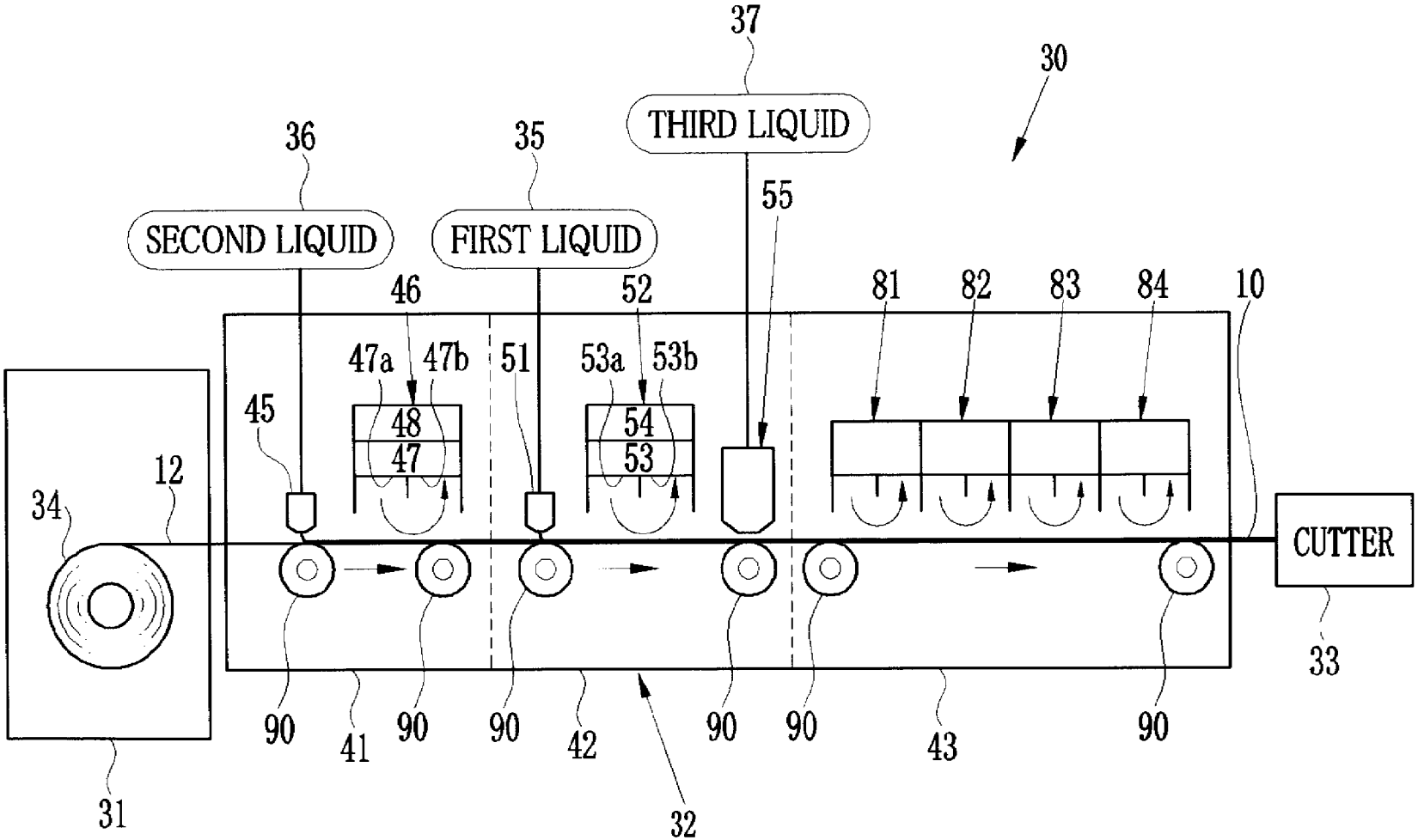
FIG. 4 is a schematic view of a porous film producing apparatus.

As shown in FIG. 4, a porous film producing apparatus 30 of the present invention includes a support feeder 31, an application chamber 32, and a cutter 33. The support feeder 31 pulls out the support 12 from a support roll 34 and sends the support 12 to the application chamber 32. In the application chamber 32, the first liquid 35, a second liquid 36, and a third liquid 37 are applied on the support 12 and dried to produce the porous film 10. The cutter 33 cuts the produced porous film 10 to a predetermined size. The cut porous film 10 is referred to as product film. The product film is subject to various processing. Thus, an end product film is produced.

The support feeder 31 and the cutter 33 are used for continuous mass production of the porous film 10, and may be omitted depending on a production scale. In a small scale production, cut sheets may be used instead of the support roll 34. The cut sheets are the support 12 cut into sheet form.

The application chamber 32 is partitioned into a first chamber 41, a second chamber 42, and a third chamber 43. In the first chamber 41 are provided a first die 45 and a dryer 46. The second liquid 36 is applied onto the support 12 from the first die 45. The dryer 46 is provided with a duct 47 having an outlet 47*a* and an intake 47*b*, and an air feeder 48. The air feeder 48 controls temperature, humidity, and velocity of dry air fed from the outlet 47*a*, and draws gas (air and vapors) surrounding the film from the intake 47*b* and circulates it. The supply of dry air and the suction of the gas by the air feeder 48 dry the film. Thus, the middle layer 13 is formed.

The second chamber 42 is provided with a second die 51, a moist air (humidified air) supply unit 52 and an inkjet-type liquid supply unit 55. The inkjet-type liquid supply unit 55 is a liquid supply unit of an ink-jet type, and applies (ejects) a liquid as fine droplets to a film surface. The first liquid 35 is applied onto the middle layer 13 from the second die 51. The moist air supply unit 52 is provided with a duct 53 having an outlet 53*a* and an intake 53*b*, and an air feeder 54. The air feeder 54 controls temperature, dew point, and humidity of moist air fed from the outlet 53*a*, and draws and exhausts gas surrounding the film from the intake 53*b*. The supply of moist air and the suction of the gas by the air feeder 54 control relative humidity in an atmosphere close to the applied first liquid 35 below an inkjet head 60 (see FIG. 5) in a range from 40% to 95%. In a case that the relative humidity is less than 40%, droplets ejected from the inkjet head 60 decrease in size or number, or may be evaporated. As a result, the droplets cannot be formed properly in the film. In a case that the relative humidity exceeds 95%, the film is covered with water. As a result, it becomes impossible to form the droplets in the film.

Figure 5:
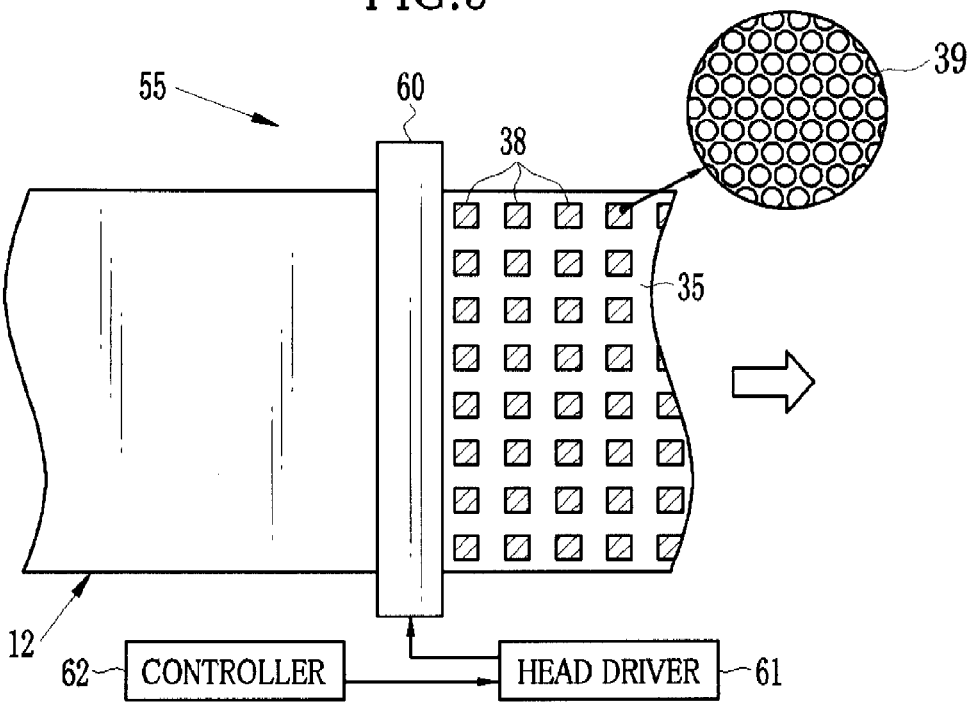
FIG. 5 is a schematic plane view showing an example of an inkjet-type liquid supply unit of a line printing method.

As shown in FIG. 5, the inkjet-type liquid supply unit 55 applies (ejects) the third liquid 37 as fine droplets on the film of the first liquid 35. Thereby, a plurality of droplets 39 are supplied on the film of the first liquid 35 to form porous areas 38 in an island structure. Hereinafter, this process is referred to as droplets supplying process. In this embodiment, the plurality of porous areas 38 are formed in a matrix in the film of the first liquid 35. Alternatively, the porous areas 38 may be formed all over the film of the first liquid 35.

During and immediately after the droplets supplying process, a film surface temperature TS of the film of the first liquid 35 is adjusted to be at least 0° C. and at most 30° C. Relative humidity of atmosphere close to the film of the first liquid 35 is adjusted to be at least 40% and at most 95% to prevent decrease of the droplets 39 in size and number and evaporation of the droplets caused by drying. One of the film surface temperature TS and a dew point TD is controlled to lower the film surface temperature TS than the dew point TD to satisfy (TD-TS)>0° C. A temperature control mechanism is provided close to the film below the inkjet-type liquid supply unit 55 to control the film surface temperature TS. To control the film surface temperature TS of the film, there are methods such as controlling a surface temperature of a roller in contact with the film, or using a temperature control plate disposed on the opposite side of the film, close to the support 12 between the rollers. The film surface temperature TS is measured by providing, for example, a non-contact thermometer such as a commercially available infrared thermometer close to the conveying path of the film.

The dew point TD is controlled by changing conditions of moist air fed from the outlet. In this case, a unit similar to the moist air supply unit 52 is disposed in the downstream from the inkjet-type liquid supply unit 55 in a moving direction of the support 12 to control the dew point TD. Setting the film surface temperature TS lower than the dew point TD prevents evaporation of the droplets.

Figure 6:
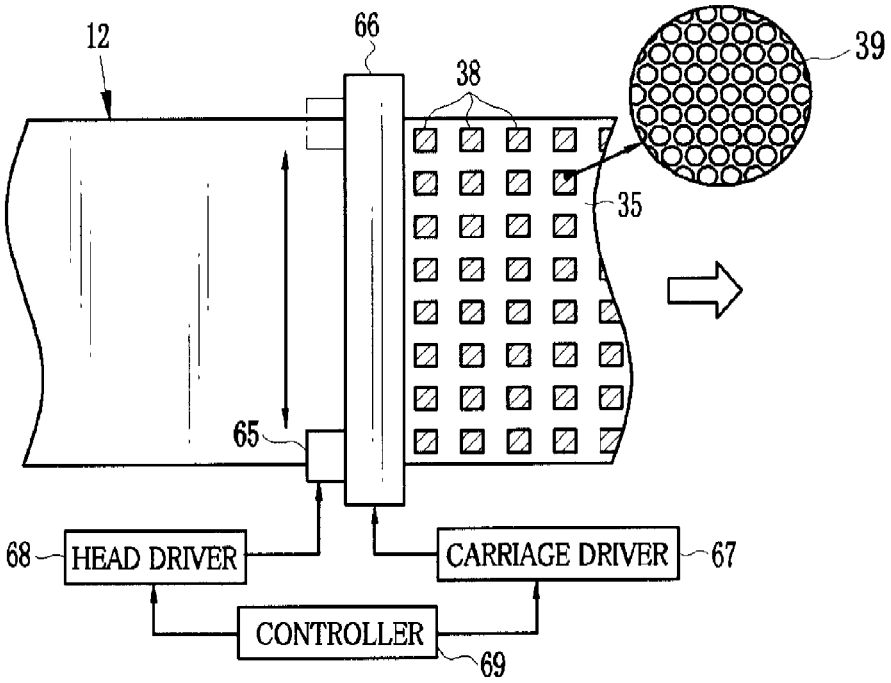
FIG. 6 is a schematic plane view showing an example of an inkjet-type liquid supply unit of a serial printing method.

A printing method of the inkjet-type liquid supply unit 55 may be either a line printing method shown in FIG. 5 or a serial printing method shown in FIG. 6. In this embodiment, the line printing method is adopted even though the inkjet head 60 is large. In the line printing method, the third liquid 37 is applied to the film of the first liquid 35 across the width direction of the support 12, and the support 12 is conveyed continuously.

The inkjet-type liquid supply unit 55 is provided with the inkjet head 60, a head driver 61, and a controller 62, and has a structure of a common ink jet printer except that the third liquid 37 is used instead of ink. The third liquid 37 is ejected as droplets that will form pores in the porous film.

In the line printing method, the inkjet head 60 with a plurality of orifices aligned in an array in the width direction of the support 12 is used. The third liquid 37 is ejected from the inkjet head 60, in synchronization with the conveyance of the support 12. Thus, the porous area 38 is formed in the film of the first liquid 35. In the line printing method, since the third liquid 37 is concurrently applied across the width direction of the support 12 using the inkjet head 60, the support 12 is conveyed continuously.

The inkjet head 60 is provided with one or more plural ejection lines each having the orifices aligned in the width direction of the support 12. In a case that the plural ejection lines are used, the size of the droplets are increased by ejecting the third liquid 37 plural times to the same positions where the third liquid 37 has been ejected by the previous ejecting line. In addition, the size of the droplets can be increased by ejecting the third liquid 37 concurrently from adjacent orifices and joining the ejected droplets on the film. The size of the droplets can be changed by changing an ejection amount from each orifice. Furthermore, the size of the droplets can be changed by the combination of the above methods.

As shown in FIG. 6, in spite of the advantage that an inkjet head 65 of the serial printing method is smaller than the inkjet head 60 of the line printing method, the serial printing method requires a carriage 66 and a carriage driver 67 for moving the inkjet head 65 in the width direction of the support 12, a head driver 68, and a controller 69. The inkjet head 65 is provided with a plurality of orifices formed in the conveying direction of the support 12. The inkjet head 65 is moved along the carriage 66 in the width direction of the support 12 by the carriage driver 67. Thereby, a printing area is printed as a swath of one line of the orifices by one pass of the inkjet head 65 across the carriage 66. The support 12 is conveyed intermittently after each pass. During the printing of the printing area, the support 12 is held still.

Figure 7A:
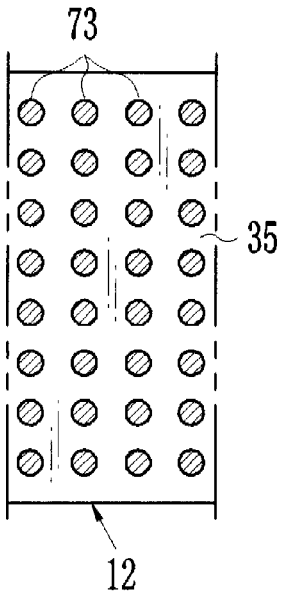
FIG. 7A is an application pattern of porous areas to which droplets of a uniform diameter are supplied.
Figure 7B:
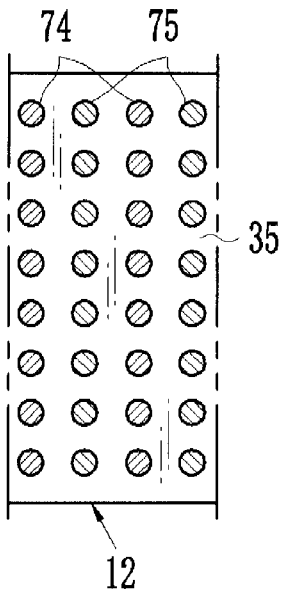
FIG. 7B is an application pattern of two kinds of porous areas which differ in diameter of droplets supplied.
Figure 7C:
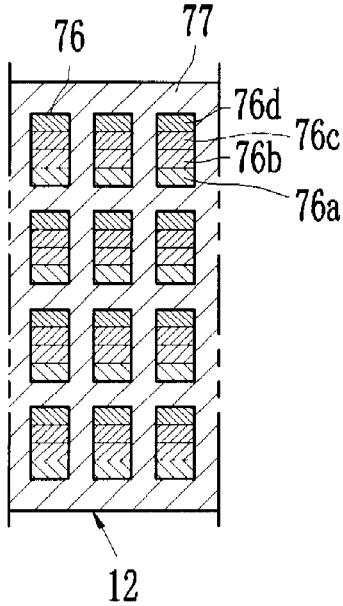
FIG. 7C is an application pattern of porous areas each supplied with droplets of four different diameters, and a third liquid that prevents condensation is applied to areas other than the porous areas.

FIGS. 7A, 7B, and 7C are examples of patterning of the porous area. In FIG. 7A, circular porous areas 73 are arranged in a matrix by applying the third liquid 37 on the film of the first liquid 35. In FIG. 7B, two kinds of porous areas 74 and 75 are aligned separately from each other. The porous areas 74 and 75 differ from each other in the size of the droplets supplied. Namely, two kinds of the porous areas 74 and 75 differ from each other in diameter of the pores. In FIG. 7C, rectangular porous areas 76 are arranged in a matrix using the third liquid 37. Additionally, a fourth liquid 40 different from the third liquid 37 of the porous area 76 is applied to an area on the film of the first liquid 35 except for the porous areas 76. The area to which the fourth liquid 40 is applied is referred to coated area 77. The coated area 77 has resistance to condensation or does not cause condensation. A coated area may be formed in the cases shown in FIGS. 7A and 7B using the fourth liquid 40 for forming the coated area.

In addition to circular and rectangular shapes shown in FIGS. 7A to 7C, the porous areas (pore forming areas) 73 to 76 may take polygonal, ellipsoidal, doughnut-like, heart-like, or other shapes. The arrangement of the porous areas 73 to 76 is not limited to the matrix. The porous areas 73 to 76 may be arranged in a random manner.

Figure 8A:
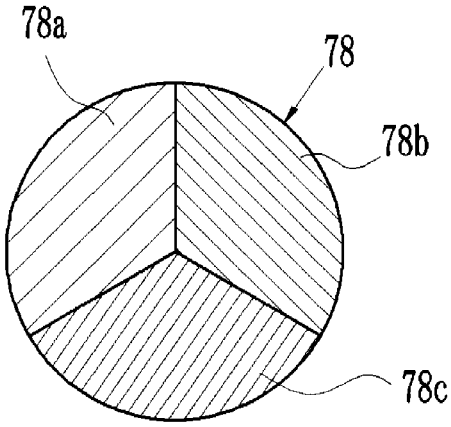
FIGS. 8A and 8B are plane views showing examples of application patterns of porous areas each divided into plural divided areas that differ in diameter of the droplets supplied.
Figure 8B:
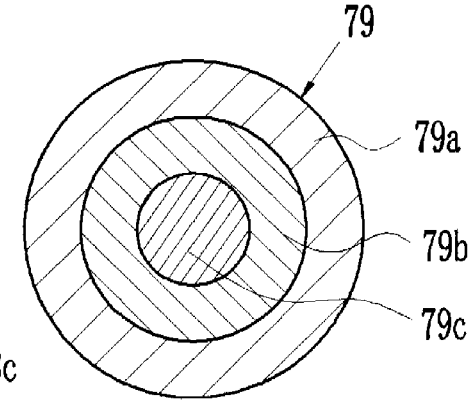

As shown in FIGS. 8A and 8B, plural kinds of the third liquid 37 may be used separately in each of the porous areas (pore forming areas) 78 and 79 to form different divided areas in each of the porous areas 78 and 79. For example, in FIG. 8A, the circular porous area 78 is divided into three sectors (divided areas) 78*a* to 78*c* using radioactive rays. The diameter of the droplets is changed on the divided area basis. Alternatively, as shown in FIG. 8B, divided areas 79*a* to 79*c* may be formed concentrically in the circular porous area 79. The diameter of the droplets may be increased or decreased from the circumference to the center of the porous area 79. The porous area may be divided in other ways.

As shown in FIG. 7C, the rectangular porous area 76 may be divided into four divided areas 76*a* to 76*d*. The divided areas 76*a* to 76*d* differ from each other in diameter of the droplets supplied. The droplets may be gradually increased or decreased in diameter from the divided area 76*a* to the divided area 76*d* in this order.

In the third chamber 43 are provided first to fourth supply and suction units 81 and 84 (see FIG. 4). In the third chamber 43, the droplets and the solvents are evaporated. Each of the first to fourth supply and suction units 81 and 84 has a duct and an air feeder. Each duct has an intake and an outlet. The air feeder controls a temperature, a dew point, humidity, and a flow amount of dry air fed from the outlet, and draws and exhausts gas surrounding the film from the intake. The first to the fourth supply and suction units 81 and 84 are configured similar to the dryer 46.

As the support 12 passes through the first to the third chamber 41 to 43, the droplets 39 are ejected on the film of the first liquid 35 from the inkjet head 60, and the droplets 39 are dried in the third chamber 43. Thus, the porous film 10 having the porous layer 11 shown in FIGS. 1 and 2 is produced.

The size and the arrangement of the pores in the porous area 38 differ depending on a density and a size of the droplets, a drying speed, a solid concentration of the liquid for forming the porous layer, timing of evaporating the solvent in the liquid, and the like. The diameter and the density of the pores can be adjusted to desired values by changing the above conditions.

In each of the first to the third chambers 41 to 43 are provided a plurality of rollers 90 with appropriate pitches. The representative rollers 90 are shown in FIG. 4. Illustration of the other rollers 90 is omitted. Each roller 90 has a drive roller and a free roller. Throughout the first to the third chambers 41 to 43, the support 12 is conveyed at a constant speed with the use of the drive rollers disposed with the appropriate pitches. A temperature of each roller 90 is controlled by a temperature controller (not shown) in each chamber so that the processes, such as the film drying process, the droplets growing process, and the pore forming process are performed in optimum conditions. A temperature plate (not shown) is disposed on the opposite side of the film surface, close to the support 12 between the rollers 90. The temperature control plate controls the temperature of the support 12 at a predetermined temperature.

In each of the first to the third chambers 41 to 43 of the application chamber 32, a solvent recovery device (not shown) is provided. The solvent recovery device recovers the solvent. The recovered solvent is refined in a refining device (not shown) and reused.

Next, an operation of this embodiment is described. As shown in FIG. 4, in the first chamber 41, the second liquid 36 is applied from the first die 45 onto the support 12 to form the film of the second liquid 36. The film of the second liquid 36 is dried by the dryer 46. Thus, the middle layer 13 is formed.

In the second chamber 42, the first liquid 35 is applied from the second die 51 onto the middle layer 13 to form the film of the first liquid 35. The first liquid 35 is applied such that the thickness of the film of the first liquid 35 before being dried is in a range from 0.01 mm to 1 mm. Even though the thickness is within the above range, the droplets may become random if the thickness varies. In a case that the thickness is less than 0.01 mm, the film of the first liquid 35 cannot be formed uniformly, and the first liquid 35 may be repelled on the middle layer 13 and cannot cover the middle layer 13. On the other hand, in a case that the thickness is more than 1 mm, drying time becomes too long, which lowers production efficiency.

In the second chamber 42, as shown in FIG. 5, the porous areas (pore forming areas) 38 are formed by ejecting the third liquid 37 as droplets 39 on the film of the first liquid 35 with the use of the inkjet-type liquid supply unit 55. The droplets 39 are formed in the porous areas 38. Since the droplets 39 are formed using the inkjet head 60, the droplets 39 of the predetermined size and pitch are speedily formed contrasted with conventional droplets forming methods by condensation. Additionally, the porous area 38 can be divided into plural divided areas and the diameter of the droplets 39 can be changed on the divided area basis. The porous area 38 can be formed to cover the entire film, or with predetermined patterns.

In the third chamber 43, one of the film surface temperature TS or the dew point TD is controlled with the use of the four supply and suction units 81 to 84 so as to set the film surface temperature TS higher than the dew point TD. The film surface temperature TS is mainly controlled by the temperature control plate. The dew point TD is controlled by controlling conditions of the dry air supplied from the outlet. The film surface temperature TS is measured by providing the temperature measuring device similar to the above close to the film. By setting the film surface temperature TS higher than the dew point TD, the growth of the droplets is stopped and the droplets are evaporated. Thus, the porous film with the uniform pores is produced. If the dew point TD is set equal to or higher than the film surface temperature TS ($TS \leqq TD$), further condensation occurs on the droplets and may damage the porous structure, which is unfavorable.

A main objective of providing the third chamber 43 is to evaporate droplets therein. The remaining solvent in the film is also evaporated in the third chamber 43.

In the droplets evaporation process in the third chamber 43, a decompression drying device or a so-called 2D nozzle may be used instead of the supply and suction units 81 to 84. Decompression drying makes it easy to adjust evaporation speeds of the organic solvent and the droplets individually. Thereby, the droplets are formed inside the film and evaporated together with the organic solvent in better conditions. The pores controlled to be uniform in size, shape, and conditions are formed at the positions of the droplets. The 2D nozzle has supply nozzles for supplying air and suction nozzles for sucking air close to the film. The supply nozzles and the suction nozzles are arranged alternately in the support conveying direction.

Figure 9:
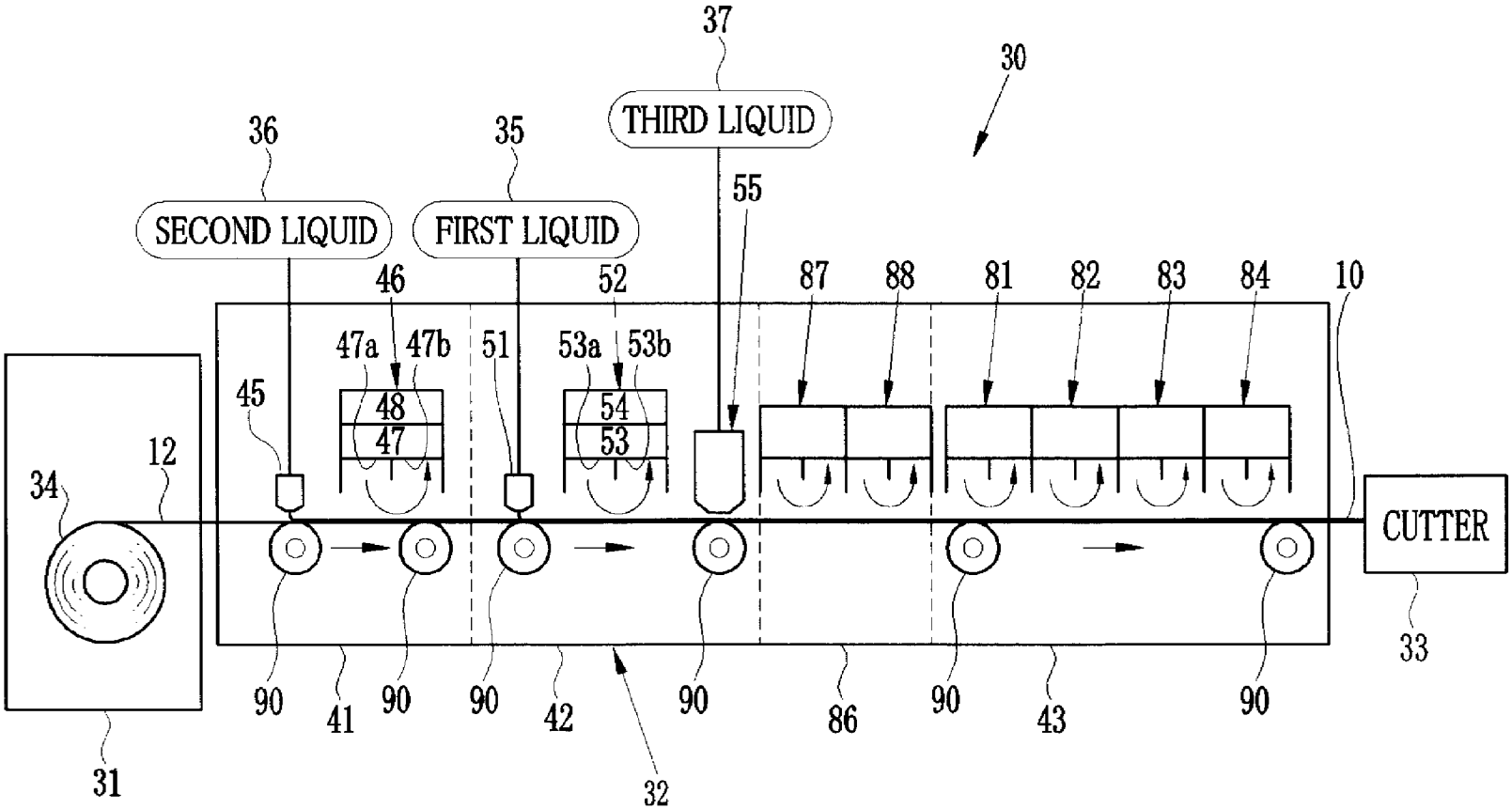
FIG. 9 is a schematic view of a porous film producing apparatus of another embodiment to which a fourth chamber for growing the droplets is added.

As shown in FIG. 9, a fourth chamber 86 is provided between the second chamber 42 and the third chamber 43 as necessary. The fourth chamber 86 is used for growing the droplets 39. Supply and suction units 87 and 88 may be disposed in the fourth chamber 86. Components similar to those of the porous film producing apparatus 30 in FIG. 4 are designated by the same numerals shown in FIG. 4, and descriptions thereof are omitted. In the fourth chamber 86, with the use of the supply and suction units 87 and 88, the droplets 39 that have been supplied to the surface of the film in the second chamber 42 gradually increase in size (diameter). The first solvent may be evaporated at least one of during and after the growth of the droplets 39.

To grow the droplets 39 in the fourth chamber 86 efficiently, the film surface temperature TS or the dew point TD is controlled such that $\Delta T$ (=TD−TS) is more than 0° C. and less than 20° C. ($0° C. < \Delta T < 20° C.$). The film surface temperature TS is measured by the non-contact thermometer such as the infrared thermometer provided close to the conveying path of the film. The film surface temperature TS is controlled by the temperature control plate (not shown) provided close to the film. The temperature control plate is disposed opposite to the film surface, close to the support 12. The temperature control plate changes the film surface temperature TS along the conveying direction of the support 12. To change the dew point TD, conditions of moist air supplied from the outlet are controlled. By setting the conditions of the fourth chamber 86 as described above, the droplets 39 grow slowly and gradually and arrangement of the droplets 39 is promoted by capillary force. Thus, the uniform droplets 39 are densely formed.

In a case that $\Delta T$ is lower than 0° C., the droplets 39 are not densely packed due to their insufficient growth. As a result, the size, the shape and the arrangement of the pores may become nonuniform in the porous film 10. In a case that $\Delta T$ is higher than 20° C., the droplets 39 may be formed in multilayer structure (in three dimensions). As a result, the size, the shape and the arrangement of the pores may become nonuniform in the porous film 10. In the fourth chamber 86, it is preferred that the film surface temperature TS and the dew point TD are substantially equal.

It is preferred to evaporate as much solvent as possible while the droplets 39 grow. By setting the film surface temperature TS and the dew point TD within the above range in the fourth chamber 86, the solvent in the film is sufficiently evaporated, while abrupt evaporation is prevented. It is preferred to selectively evaporate the solvent without evaporating the droplets 39. For this reason, it is preferred that the solvent has higher evaporation speed than that of the droplets at the same temperature and pressure. Thereby, the droplets 39 reach inside the film more easily when the solvent is evaporated.

Each of the first and second liquids may be (1) applied and spread onto a support placed still, (2) applied using an inkjet-type liquid supply unit, or (3) applied onto a moving support from a die, for example. Any of the above methods can be used in the present invention. In general, the methods (1) and (2) are suitable in producing many kinds of porous films in small quantities, namely, a so-called production of many models in small quantities. In general, the method (3) is suitable for the mass production. In any case, a long porous film is produced by applying or casting the liquid continuously, and a porous film of a predetermined length is produced by applying or casting the liquid intermittently.

In a case a cut-sheet shaped support is used instead of the belt-like continuous support 12 shown in FIG. 4, the porous film is produced by conveying the support from the first chamber to the third chamber in this order in the same manner as the continuous support. Alternatively, for the cut-sheet shaped support, the application chamber may be used without partitioning the inside. In this case, applications of the second liquid for forming the middle layer, the first liquid for the porous layer, and the third liquid for forming the porous area, and the drying process may be performed in the same application chamber.

Various changes and modifications are possible in the present invention and may be understood to be within the present invention.

What is claimed is:

1. A method for producing a porous film having a plurality of pores comprising the steps of:

forming a film by applying a first liquid on a support, said first liquid containing a polymer compound and a solvent;

supplying droplets of a second liquid from an inkjet head on said film; and evaporating said solvent and said droplets to form said plurality of pores in said film.

2. The method of claim 1, wherein said first liquid or said second liquid contains an amphipathic compound.

3. The method of claim 1, wherein said supplying step is performed in an atmosphere at relative humidity in a range from 40% to 95%.

4. The method of claim 1, wherein after said supplying step and before said evaporating step, said film is placed in an atmosphere at relative humidity in a range from 40% to 95%.

5. The method of claim 1, wherein said supplying step is performed while a surface temperature of said film is kept in a range from 0° C. to 30° C.

6. The method of claim 1, wherein said second liquid contains fine particles.

7. The method of claim 1 further comprising the step of growing said formed droplets.

* * * * *